US006457714B1

(12) United States Patent
Feola

(10) Patent No.: US 6,457,714 B1
(45) Date of Patent: Oct. 1, 2002

(54) POKER-TYPE GAME OF CHANCE

(76) Inventor: John Feola, 42 Irving St., Medford, MA (US) 02155

( * ) Notice: Subject to any disclaimer, the term of this patent is extended or adjusted under 35 U.S.C. 154(b) by 0 days.

(21) Appl. No.: 09/558,742

(22) Filed: Apr. 21, 2000

Related U.S. Application Data

(63) Continuation-in-part of application No. 09/540,315, filed on Mar. 31, 2000, which is a continuation-in-part of application No. 09/312,562, filed on May 14, 1999, now Pat. No. 6,149,156.

(51) Int. Cl.[7] ..... A63F 3/00
(52) U.S. Cl. ..... 273/274; 273/292; 463/11
(58) Field of Search ..... 273/274, 292, 273/236, 303; 463/11–13

(56) References Cited

U.S. PATENT DOCUMENTS 1,527,929 A * 2/1925 Simons ..... 273/139
4,560,161 A * 12/1985 Hamano ..... 463/13
5,092,598 A * 3/1992 Kamille ..... 273/139
5,823,873 A * 10/1998 Moody ..... 273/292
6,033,306 A * 3/2000 De Souza ..... 273/139
6,206,780 B1 * 3/2001 Awada
6,270,405 B1 * 8/2001 Ferguson

* cited by examiner

*Primary Examiner*—Benjamin H. Layno
*Assistant Examiner*—Vishu K Mendiratta
(74) *Attorney, Agent, or Firm*—Morse, Altman & Martin

(57) ABSTRACT

A card game comprising a computer randomly selecting a unique card value for each card of a set of cards, allowing a player to choose a predetermined number of cards from the entire set as chosen cards, revealing the card values for at least the chosen cards, forming a hand from the card values of the chosen cards, and comparing the hand to a set of winning hands in a payout schedule. The player chooses cards from a displayed grid. The player may be provided with a way to carry chosen cards over from the previous game and/or to have the chosen cards chosen randomly. The chosen cards and/or selected card values may be displayed on another grid. Payouts may be made to the player based on the payout schedule.

13 Claims, 13 Drawing Sheets

CARD GAME

$ JACKPOT AMOUNT

| Guaranteed Five | |
|---|---|
| Royal Flush | $20,000 |
| Straight Flush | 2,000 |
| Four of a Kind | 100 |
| Full House | 50 |
| Flush | 25 |
| Straight | 15 |
| Three of a Kind | 10 |
| Two Pair | 4 |
| One Pair | 1 |

| Five Card Match | |
|---|---|
| Royal Flush | % |
| Straight Flush | % |
| Four of a Kind | % |
| Full House | % |
| Flush | % |
| Straight | xx |
| Three of a Kind | xx |
| Two Pair | xx |
| One Pair | xx |

| Seven Card Match | |
|---|---|
| Royal Flush | % |
| Straight Flush | % |
| Four of a Kind | % |
| Full House | % |
| Flush | % |
| Straight | xx |
| Three of a Kind | xx |
| Two Pair | xx |
| One Pair | xx |

| Guaranteed Seven | |
|---|---|
| Royal Flush | $2,500 |
| Straight Flush | 300 |
| Four of a Kind | 100 |
| Full House | 10 |
| Flush | 5 |
| Straight | 3 |
| Three of a Kind | 2 |
| Two Pair | 1 |
| One Pair | 0 |

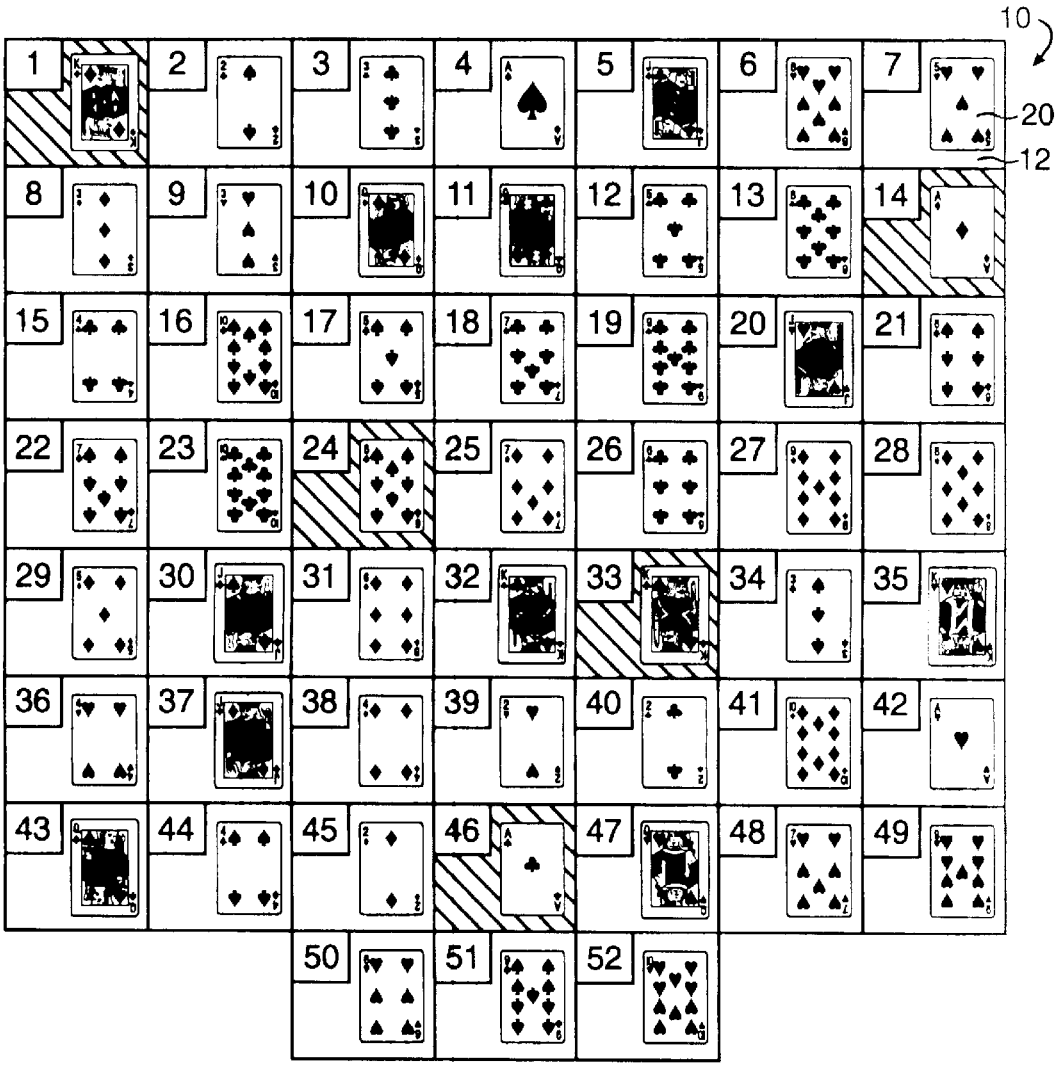

FIG. 8

CARD GAME

| $ | Select 5 Numbers | $ | Select 5 Numbers | $ | Select 5 Numbers | $ | Select 5 Numbers |
|---|---|---|---|---|---|---|---|
| 1 | 4 8 12 16 20 | 1 | 4 8 12 16 20 | 5 | 4 8 12 16 20 | 1 | 4 8 12 16 20 |
| 1 | 3 7 25 30 41 | 1 | 3 7 25 30 41 | 10 | 3 7 25 30 41 | 4 | 3 7 25 30 41 |
| 1 | 2 14 29 44 52 | 1 | 7 9 13 17 27 | 5 | 2 5 9 17 20 | 10 | 7 8 9 24 31 |
| 1 | 8 18 28 38 48 | 1 | 2 5 11 21 34 | 1 | 16 22 32 45 52 | 2 | 6 8 9 15 17 |
| 1 | 9 13 22 25 47 | 1 | 4 9 12 26 28 | 2 | 7 12 17 33 50 | 5 | 2 6 7 12 13 |
| 2 | 1 7 10 15 20 | 2 | 1 4 10 18 25 | 3 | 13 14 22 41 51 | 3 | 1 4 8 17 35 |

FIG. 13

42

POKER-TYPE GAME OF CHANCE

RELATED APPLICATIONS

The present application is a continuation-in-part application of application Ser. No. 09/540,315, filed Mar. 31, 2000 for MULTIPLE ROUND CARD GAME OF CHANCE in the name of John Feola, which is a continuation-in-part application of application Ser. No. 09/312,562, filed May 14, 1999 U.S. Pat. No. 6,149,156 for MULTIPLE ROUND CARD GAME OF CHANCE in the name of John Feola.

BACKGROUND OF THE INVENTION

1. Field of the Invention

The present invention relates to games of chance, more specifically, to a form of poker-type game that lends itself to being played as a probability type game.

2. The Prior Art

There are a number of non-casino games of chance where winners and losers are determined immediately or almost immediately after the wager is made. Such games include scratch tickets, pull-tab tickets, and keno. With scratch and pull-tab tickets, the player buys the ticket and either scratches spots or opens tabs according to the instructions for the ticket. The player knows immediately whether she is a winner or not. However, the player has little choice in what locations to scratch or open. For example, if the game being played is poker-based, the player will not be able to choose from all of the possible 52 cards because there is limited space on the ticket. This means that tickets are predetermined to be winners or losers.

Probability tickets are different in that every ticket has the potential to be a winner. There are a number of spots to scratch and the player chooses some of them, as indicated by the rules. However, the player still does not have a choice of all 52 cards.

In keno, the player chooses numbers up to a maximum, for example, choosing 10 numbers between 1 and 80. The more numbers that are matched, the greater the payout. Variations include allowing the player to select a variable number of numbers, for example, between 1 and 15 number. When run by a state, the winning numbers are drawn periodically during the day, such as every 15 minutes, and players who have chosen their numbers prior to the drawing participate. Players find out quickly whether they win or lose and then the cycle starts over again.

SUMMARY OF THE INVENTION

An object of the present invention is to provide a game played with poker-type rules in which every game can be won.

The basis of the game of the present invention is that a player chooses a predetermined number of cards from a set of cards and uses the randomly-selected card values later revealed for the player-chosen cards to form a hand that is compared to a set of winning hands, where a wager may be placed on the outcome. Payouts are generally determined by the odds of getting a particular hand. Optionally, the player may be permitted to choose more than one hand to play in a game. In one embodiment, the player must use all of the cards chosen. In another embodiment, the player is allowed to reject chosen cards and choose others to total the predetermined number of cards.

The player chooses cards from a display of a set of unique symbols, a symbol for each card of the set from which the predetermined number of cards are chosen. The display may take the form of a choosing grid of locations, where each location represents a card. How the player chooses the locations and how the choosing grid is displayed depends upon the medium on which the game is played. Having the ability to select from all cards in play means that the player has the potential to win every game, which is unlike other games that preselect a subset of the total number of possible cards for the player to choose from.

The cards chosen by the player may be indicated in the choosing grid or may be showing in another grid, the playing grid. The card values may be revealed in the choosing grid or on the playing grid, if there is one.

The present invention contemplates that the game may be played on a variety of media, including scratch or pull-tab tickets and electronic media, such as public and private video systems, and stand-alone video machines, such as personal computers and hand held game machines. With scratch ticket's, the card values are randomly selected prior to printing, and the player makes her choices by scratching the chosen cards in a grid. In public video systems, players typically make their choices by marking slips of paper or by keys or touch screens at a location remote from the controller. The choosing grid is displayed on a public video screen or matrix of video screens visible to the players at the remote location. With private standalone machines, the grid is displayed on the player's private video screen and the player's choices are made using keys or a touch screen.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein:

FIG. 8 is a drawing of the display of FIG. 1 showing five cards chosen by the player and card values selected by the controller;

FIG. 13 is an example of another slip for choosing individual games and cards.

DETAILED DESCRIPTION

Figure 1:
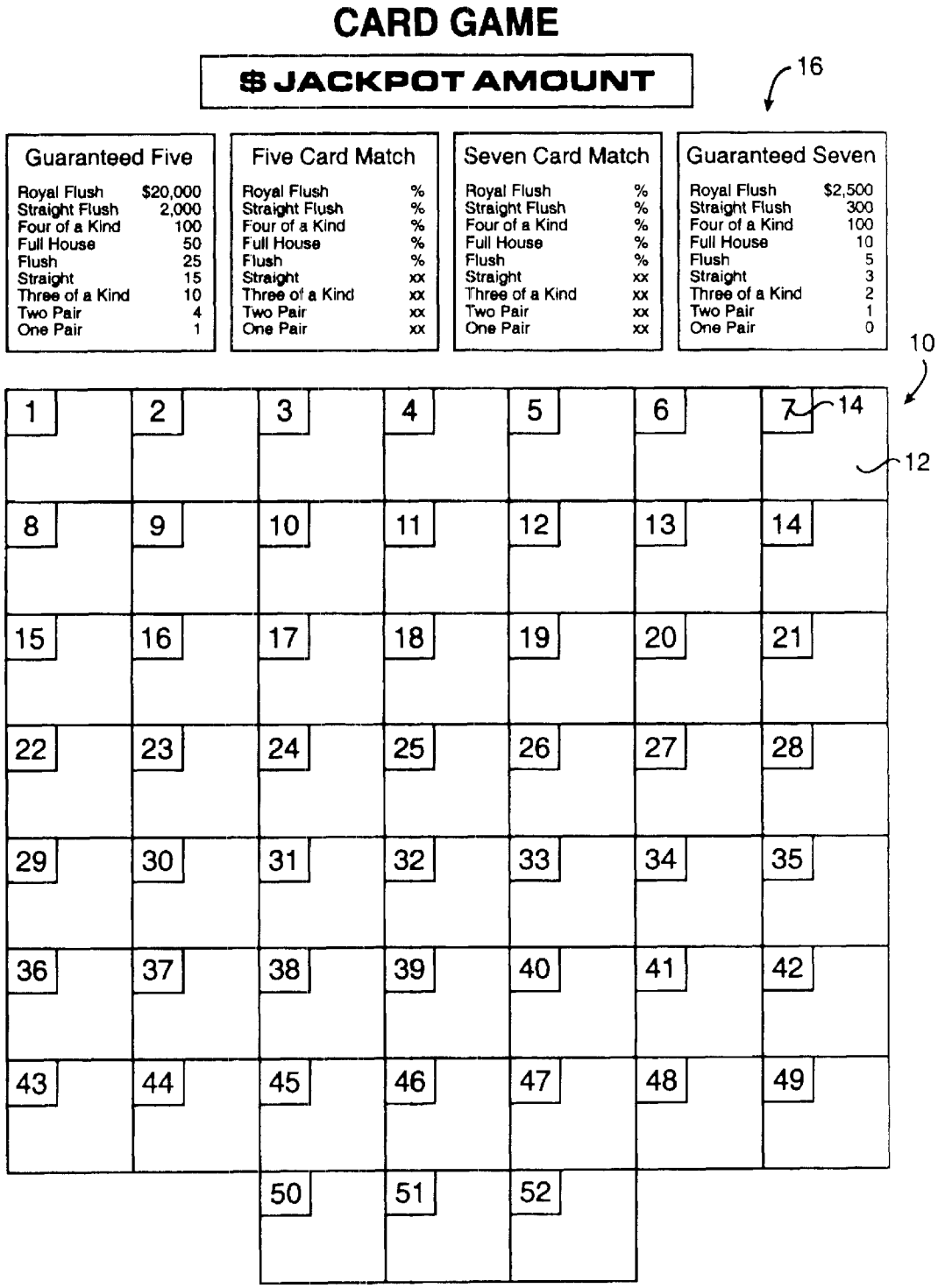
FIG. 1 is a drawing of an example display of the present invention.

The card game of the present invention provides a game based on a card game where only minimal knowledge of the rules of the underlying card game is necessary to play. The game is played with a set of basic rules and includes a number of optional enhancements. The basic game is that a player chooses a predetermined number of cards from an available set of cards, and uses the randomly selected values corresponding to those chosen cards to form a poker hand that is compared to a schedule of winning hands, where a wager may be placed on the outcome.

Game Background

The term "card" is used in the present application to indicate a playing card or any facsimile thereof. For example, a card can be a paper playing card, an image of a card on a video display, or an image of a card on a scratch ticket. Any representation of a playing card is contemplated. In addition, each card has a value which, for the standard poker decks of 52 cards, includes the suit (hearts, diamonds, clubs, spades) and the number (2–10, J,Q,K,A).

As described below, winning hands are determined by poker hand rankings. The typical poker hand has five or seven cards, as in five card draw or five or seven card stud. However, many kinds of poker-type games can be used with the present invention, the commonality between the games being is that the winning hands are determined using poker rankings. For example, the hand can be as simple as a single card ("high-card"). Or the hand may be a shortened version where the hand has three cards. Or the hand may be more complex than a standard poker hand, where the hand has more than five cards and the best five card values are used to determine its winning status. 7-card stud is an example of the latter, however, a game may be chosen that uses more than seven cards. Finally, the hand may have more than five cards, where any subset of the cards may be used to determine its winning status.

The use of standard poker rankings to determine the whether or not the hand is a winner is merely a convenience. It is used primarily because most people know the rankings and know that it is more difficult to get a straight than to get a pair. However, other card combinations are contemplated for determining winning hands, for example, a hand of all even numbered cards or a hand with at least one card from each suit. It is also contemplated that Jokers and/or wild cards may be used. It is also contemplated that games other than poker may be played. One example is a game where the sum of the cards must be less than or greater than a certain number to win. It is also contemplated that decks of cards other than the standard 52-card poker deck may be used, for example, a deck of cards of other than 52 cards and/or with different symbols. Unless otherwise indicated, the remainder of the specification assumes that the games are based upon poker hands.

When wagering on the game, the amount of payouts is typically determined by the odds of getting a particular hand. There are several ways to determine how much is paid out for a particular hand. In one, the player receives a set multiple of the amount that the player originally wagered. For example, if a player gets a full house, she receives 50 times the amount that she wagered. In another method, the player receives a percentage of a jackpot that is a percentage of wagers by all of the players for that game and/or round. For example, if a player gets a straight flush, she receives 40% of the jackpot. The third method is similar to the second, except that the percentage is taken from a cumulative jackpot, which is an accumulation of some percentage of the wagers from the previous games. Finally, non-monetary winnings are possible, such as toys, gifts, or coupons. Each game may use only one method or various combinations of methods.

The game has two types of actors, the player and the controller. The player is the person wagering on the outcome of the game and makes choices that influence that outcome. The terms "choose", "chosen", and "choice" are used in the present specification to refer to player actions and results. The controller is the entity, typically a computer, that makes random selections to which the player's choices ame compared. The terms "select" and "selections" are used in the present specification to refer to game controller actions and results.

Before game play begins, the house determines the exact rules of the game, including such items as how many cards are in a hand, the amount that can be wagered, the payout schedule, and any other rules necessary to playing the game, In the remainder of this description, poker rules are assumed.

The game begins with the player choosing the cards that she believes, after the values for those cards are revealed, will have a hand listed on the payout schedule. The number of cards that the player is allowed to choose depends upon the rules of the particular game. Typically the number will be five or seven, since these are standard poker hand sizes. However, the present invention contemplates that the hand may be of any size.

How the player chooses the cards depends upon the medium on which the game is played, and are described in detail below. All forms of media are contemplated, including public video and private video on local or widearea networks, and standalone machines, including hand-held machines and personal computers.

Several methods for the player to choose cards are contemplated by the present invention. As an initial matter, the player does not know the value of the cards that are being chosen. The player is merely picking the appropriate number of cards of unknown value from a deck.

Figure 2:
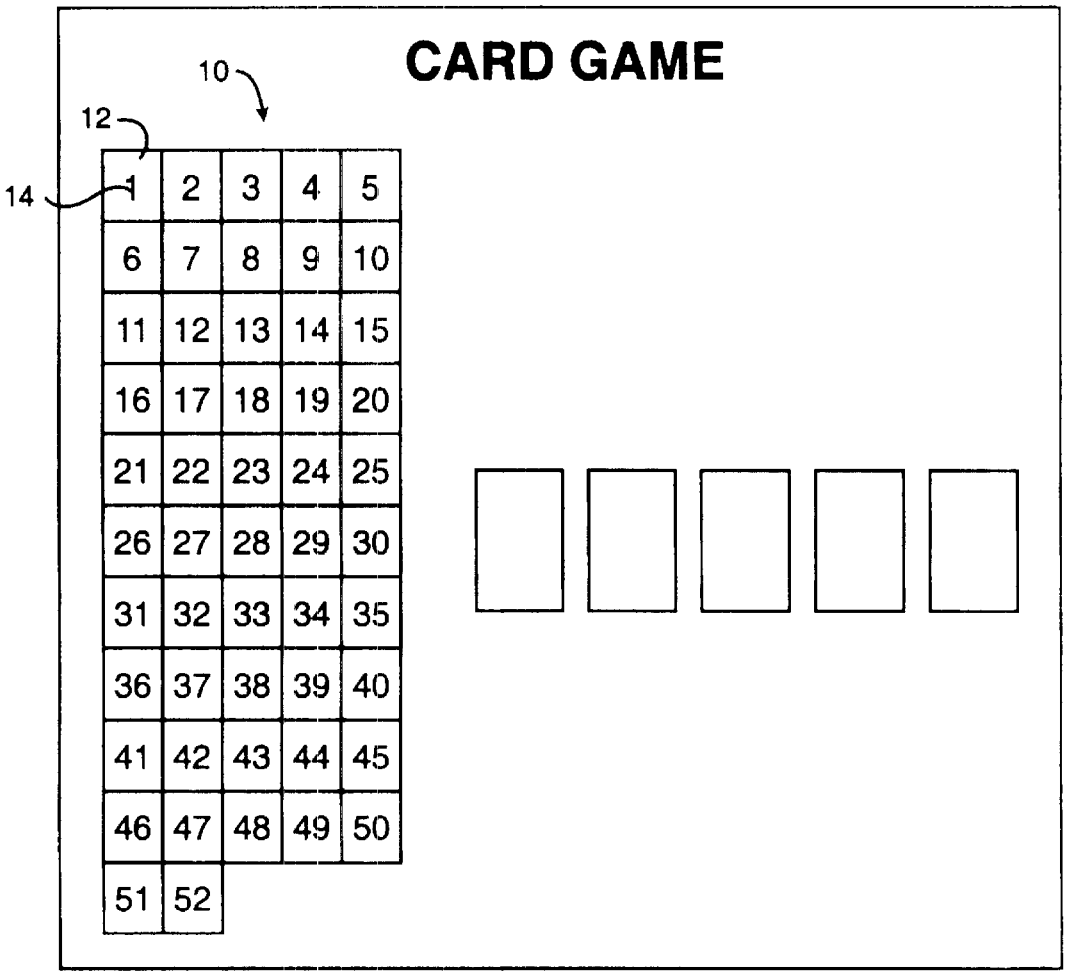
FIG. 2 is a drawing of another example display of the present invention.

In the first method for choosing cards, illustrated in FIGS. 1 and 2, the player chooses the cards from a displayed grid 10 of locations 12, where each card available to be chosen is represented by a grid location 12. This choosing grid 10 may exist on, for example, a video screen or a paper ticket. Typically, there will be 52 locations representing the number of cards in a standard 52-card poker deck of playing cards. Alternatively, fewer or more locations 12 may be displayed if a card set other than the standard 52-card deck is used. Optionally, each location 12 is denoted by a unique symbol 14, for example the numerals 1–52. In the second method, the player chooses cards from a displayed list of unique symbols, such as the numerals 1–52, rather than from a grid. In a third method, no choosing grid or list is displayed, but the player chooses from another medium, for example, a keyboard with a key for each possible card or a keypad with the numerals 0–9. In a fourth method, the player makes a "quick pick," that is, the player does not herself choose the individual cards, but instructs the controller to randomly choose the cards. The remainder of the specification assumes that the player uses the choosing grid 10 to choose cards.

Figure 3:
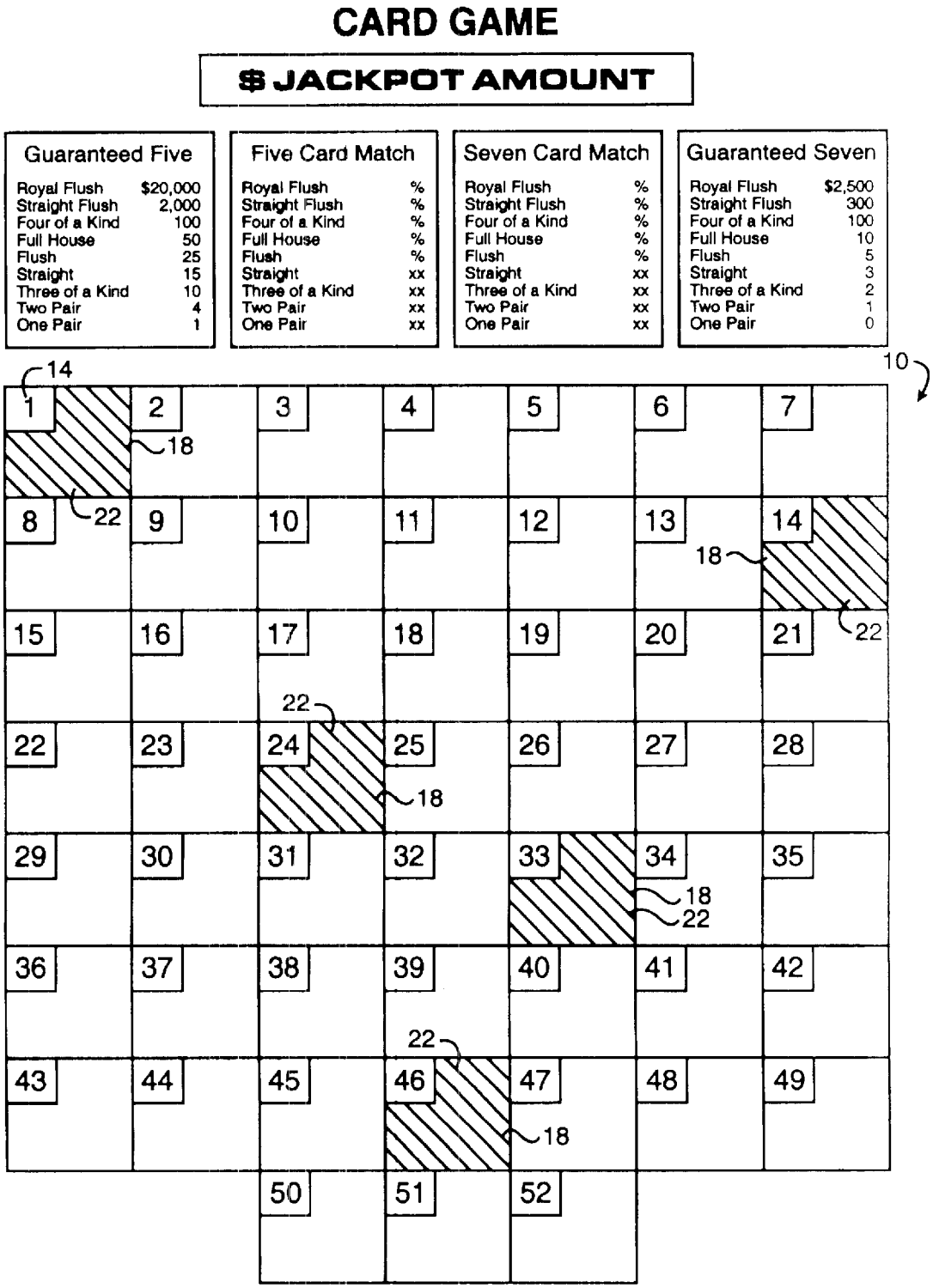
FIG. 3 is a drawing of the display of FIG. 1 showing five cards chosen by the player.

The cards chosen by the player may be displayed in some manner so that the player receives feedback as to which cards are chosen. In one method, illustrated in FIG. 3, the chosen cards 18 are shown by crosshatch lines 22 in the card locations 12 of the choosing grid 10. Please note that if the display is intended to be viewed by more than one player, the chosen cards will most likely not be shown, as it may cause confusion among the several players. Alternatively, different color backgrounds may be used to distinguish between the chosen cards of several players, although problems associated with more than one player choosing the same card may limit the usefulness of this method.

Figure 4:
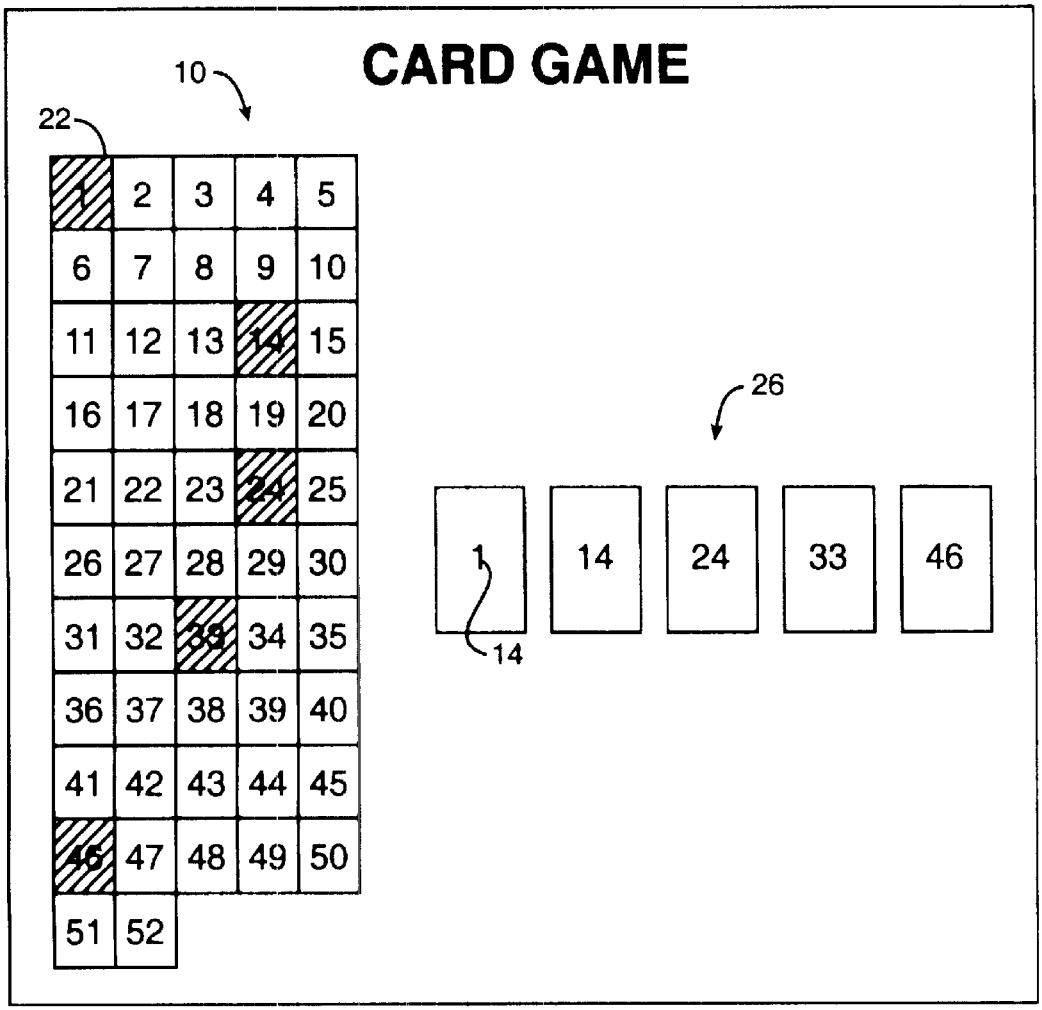
FIG. 4 is a drawing of the display of FIG. 2 showing five cards chosen by the player.

In another method, illustrated in FIG. 4, the unique symbols 14 representing the chosen cards are displayed in a playing grid 26 next to the choosing grid 10. Optionally, the chosen cards may also be shown on the choosing grid 10 by, for example, crosshatch lines 22. In a third method, most suited for when a paper ticket is used to choose cards, a paper receipt listing the chosen cards is issued to the player. All of these methods are preferred, and the present invention contemplates that any other method of providing feedback to the player can be employed.

The present invention contemplates that a player may choose cards to play more than one hand during a single game, where each hand is independent of the others. For example, in the display of FIG. 5, the playing grid 26 will show up to five hands 54 of five cards that are played during a single game. The player chooses the cards for the first hand and then is given a choice as to whether to play another hand. This continues until the maximum number of hands is reached. It is also contemplated that a different number of cards may be chosen for each hand of the same game.

Figure 6:
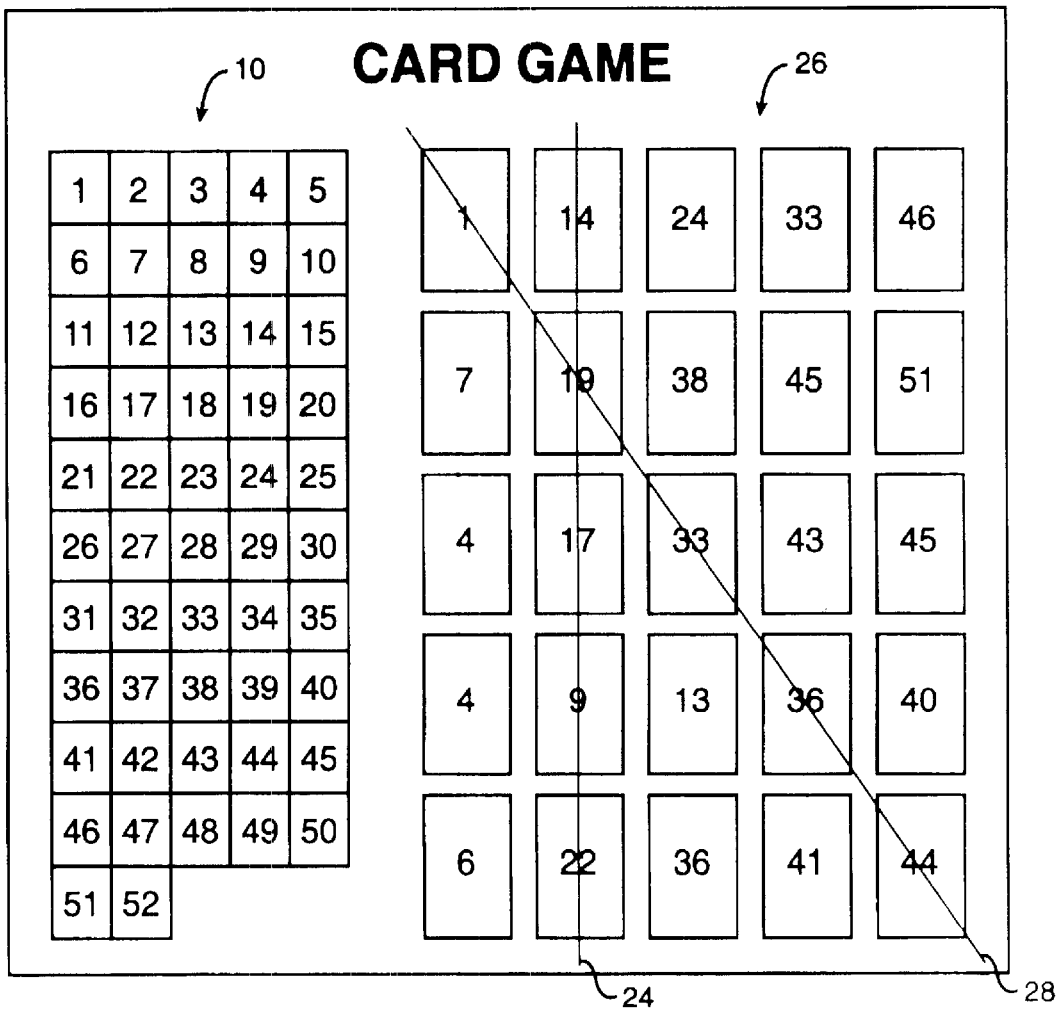
FIG. 6 is a drawing of a configuration of the display of FIG. 5 where the player is playing hands in addition to the five sets of horizontal cards.

The present invention contemplates that the player may be permitted choose one or more combinations of chosen cards to play as secondary hands. In the example display of FIG. 6, the player may have the option of choosing any five-card combinations to play as secondary hands. Examples include any vertical set of five cards, either diagonals et of five cards, a combination of the four corner cards and center card, or any other combination of five cards. FIG. 6 shows a vertical combination 24 and a diagonal combination 28. The secondary hands are treated the same as the other hands for wagering and payout purposes.

Figure 7:
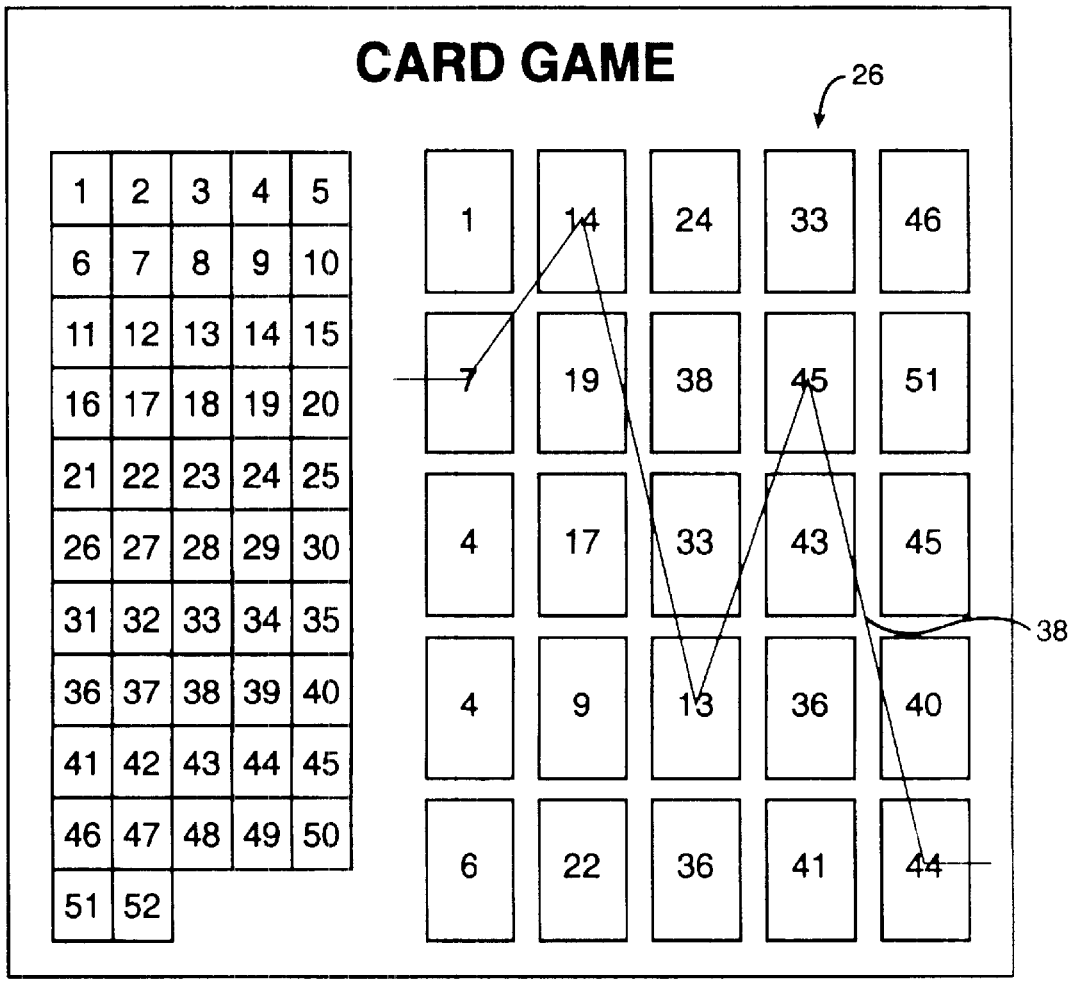
FIG. 7 is a drawing of a configuration of the display of FIG. 5 where the controller has randomly selected an other playing hand in addition to the five sets of horizontal cards.

Along the same line, the present invention contemplates that the controller may randomly select one or more combinations of the chosen cards for the player to play as secondary hands. These randomly selected secondary hands are treated the same as the player-chosen secondary hands. The randomly selected secondary hands are indicated in any number of ways, for example, by a line running through the cards, as at 38 in FIG. 7, by changing the color of the selected cards, or by displaying a symbol, such as an asterisk, in the selected cards.

The timing of the player's choices depends upon the manner in which the game is played. There are two basic forms. In the first, the timing is controlled by the players, where the choosing process is not complete until all participating players have made their choices. An example of this timing is where the player is playing at a standalone machine in a casino. In the second, the timing is controlled by a clock, where each game begins at a fixed time, and all players participating in a game must have their choices made prior to that time. An example of this timing is where the player is playing a public state-run game at one of numerous parlors throughout the state.

Typically, after the cards are chosen, the player will wager on the outcome of the game. Wagering may not occur when the game is being played strictly for fun, such as a hand held video game or as a game in a game arcade. Any manner in which the player can make a wager is contemplated by the present invention where the possibilities are dictated by the media on which the game is played. Methods of indicating the amount of wagering are described below with reference to the various playing media.

After the player has chosen her cards and placed her wager, the controller reveals the card values. The actual timing of when the card values are randomly selected is not important. Since the card values are not revealed until the appropriate time during the game, they may be randomly selected by the controller at any time prior to being revealed. The controller reveals the card values for at least the player-chosen cards. Alternatively, and if the display permits, the values for all 52 cards may be revealed. Typically, values for all the cards will be chosen. However, where only the values for the player-chosen cards are revealed, the controller may only select values for the player-chosen cards.

Figure 9:
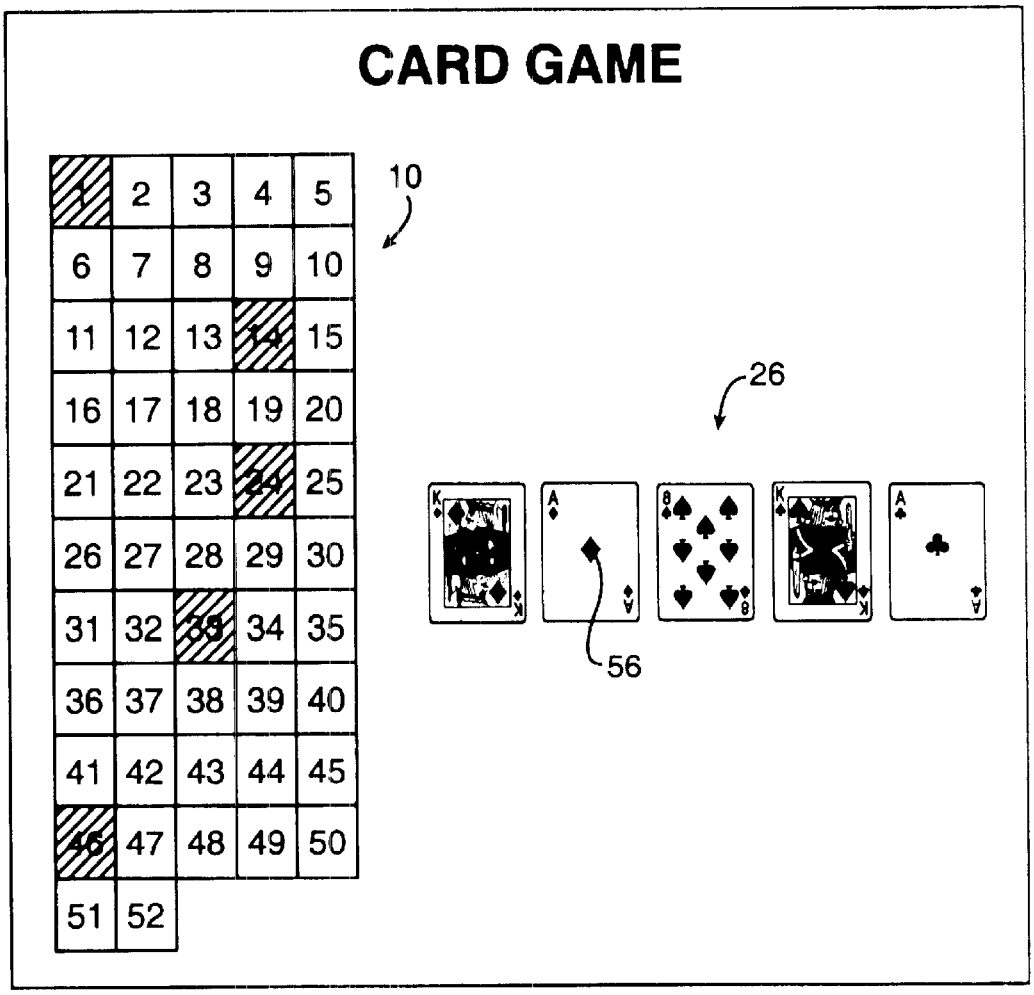
FIG. 9 is a drawing of the display of FIG. 2 showing five cards chosen by the player and card values selected by the controller.

The present invention contemplates several methods for displaying the card values randomly selected by the controller. In the first method, illustrated in FIG. 8, the selected card values are indicated by displaying the values in the card locations 12 in the choosing grid 10, as at 20. In the second method, illustrated in FIG. 9, the selected card values are displayed in the playing grid 26, as at 56.

The present invention contemplates that the card values may be revealed all at once or progressively, for example, one or several each second until all are revealed. The advantage to revealing card values in progression is that the suspense of the game is enhanced because of the extended time over which the game is played. The advantage to revealing all of the card values at once is that the game is over more quickly and more games can be played during a given period of time.

After the card values are revealed, the hands resulting from the values of the chosen cards are compared to the payout schedule. In one embodiment, the player must use the cards chosen, like in stud poker. In another embodiment, the game is played like draw poker, where the player is allowed to reject chosen cards and choose others to total five cards. If the values for all of the cards were previously revealed, then the values are again randomly selected and revealed for all rejected and newly chosen cards, leaving out the rejected cards. If only the chosen card values were revealed, there is no need to select values again, but to merely reveal the card values for the newly-chosen cards.

It is also contemplated that this game may be played as a secondary bonus to another game.

Playing Media

As indicated above, the present invention contemplates that the game may be played on a variety of media, including scratch or pull-tab tickets and electronic media, such as public systems and stand-alone machines.

Figure 10:
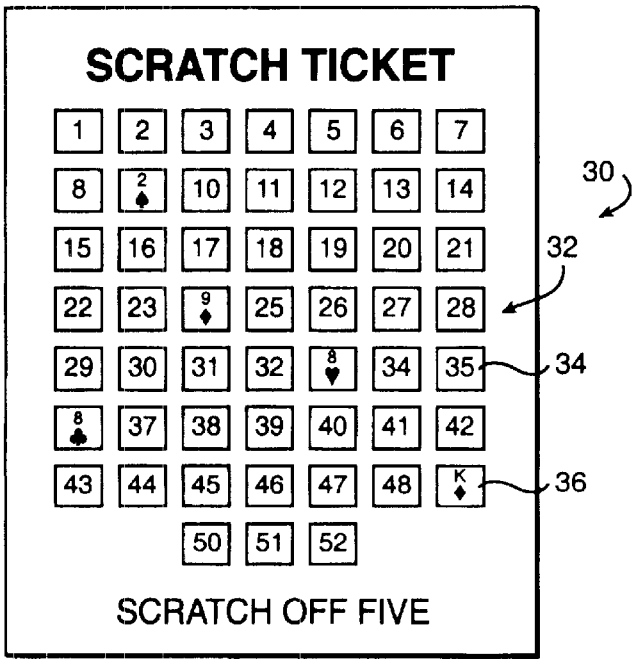
FIG. 10 shows a scratch ticket embodying the present invention.

With scratch tickets 30 or pull-tab tickets, as shown in FIG. 10, the choosing grid 32 is printed on the ticket 30, where the random selection of values for each card 34 is made prior to printing. The player wagers by paying for and receiving the ticket. The player makes her choices by scratching the chosen cards 36 and comparing the resulting hand to the payout schedule that is typically printed on the back of the ticket 30.

Figure 11:
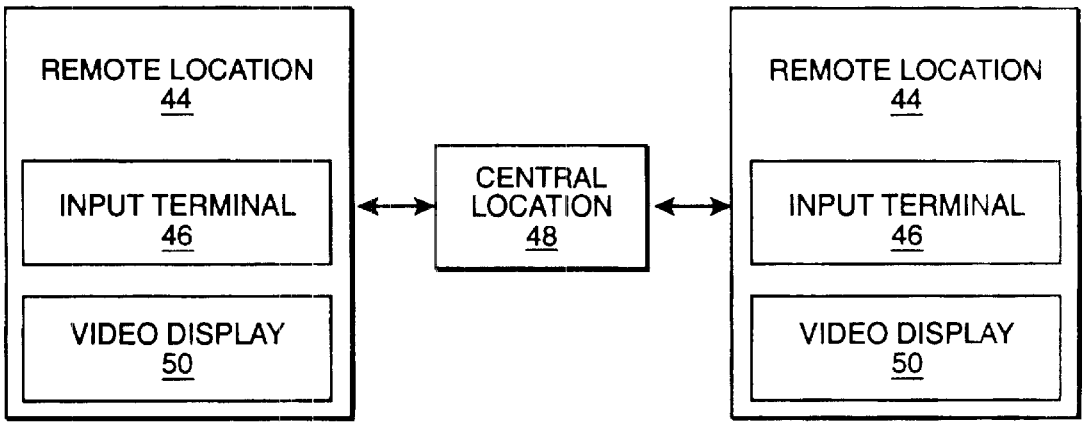
FIG. 11 is a block diagram of a public video system embodying the present invention.
Figure 12:
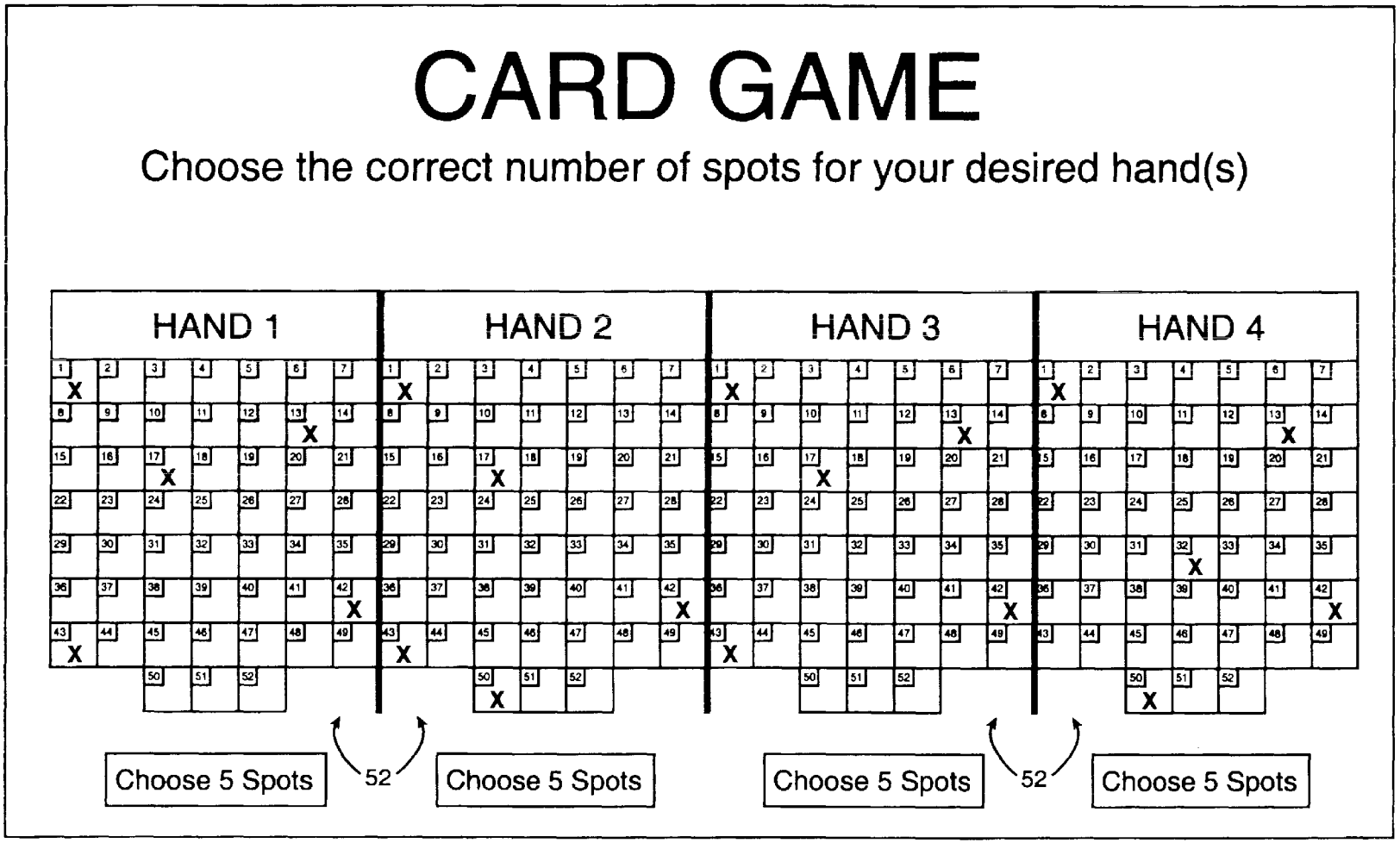
FIG. 12 is an example of a slip for choosing individual games and cards.

In public systems, a block diagram of which is shown in FIG. 11, a player typically makes her choice at a remote location 44 by marking a slip of paper that is given to a clerk with the amount of the wager in cash. The slip is then scanned into a terminal 46 that sends the choices to a central location 48. Two examples of such a slip 40, 42 are shown in FIGS. 12 and 13. Alternatively, choices can be made by keys on a keyboards keys on a key grid, or by boxes on a touch screen grid. Alternatively, the player many request a "quick pick," where the controller randomly chooses cards for the player. The player receives a receipt, such as a paper receipt, or other acknowledgement, such as an indication on a private terminal, indicating the cards chosen for each round. The choosing grid is displayed on a video screen 50 or matrix of video screens visible to the players at the remote location 44 from information received from the central location 48.

Figure 5:
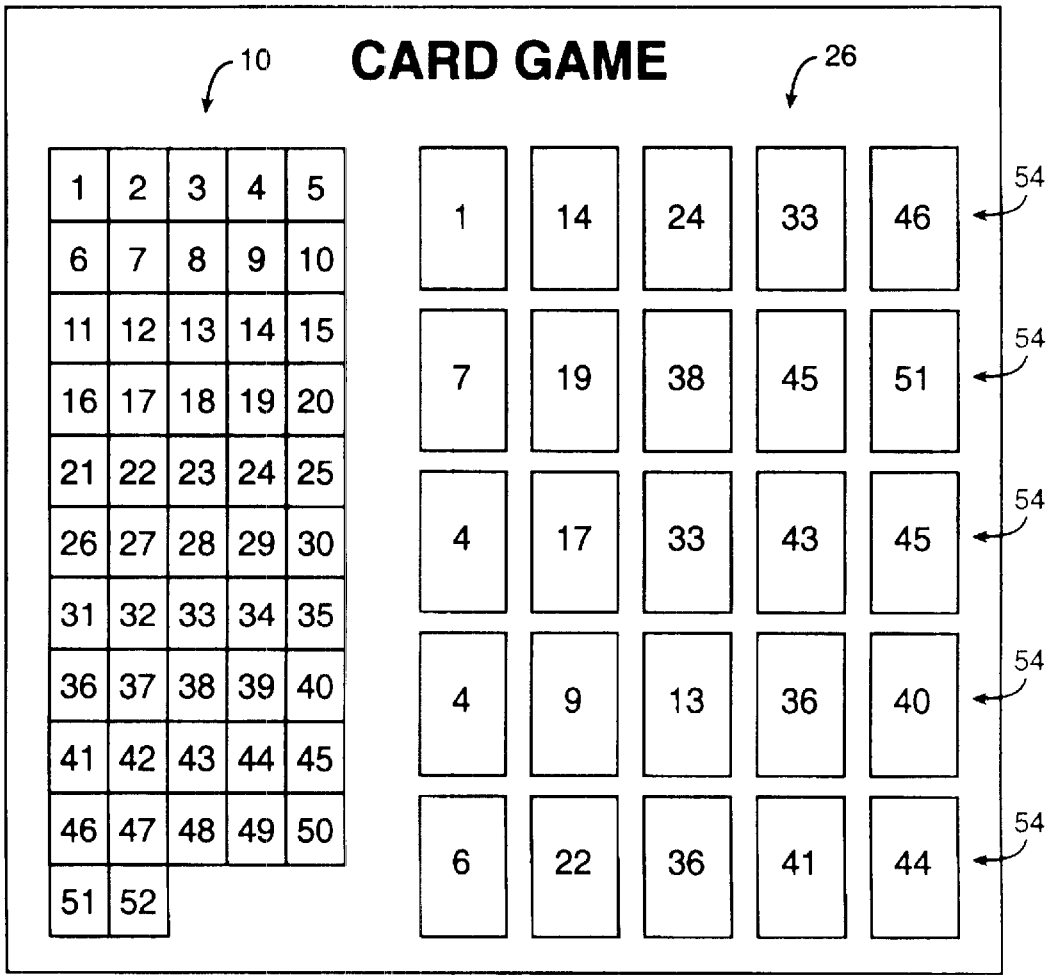
FIG. 5 is a drawing of configuration of the display of FIG. 2 where the player is playing five hands for a single game.
Figure 14:
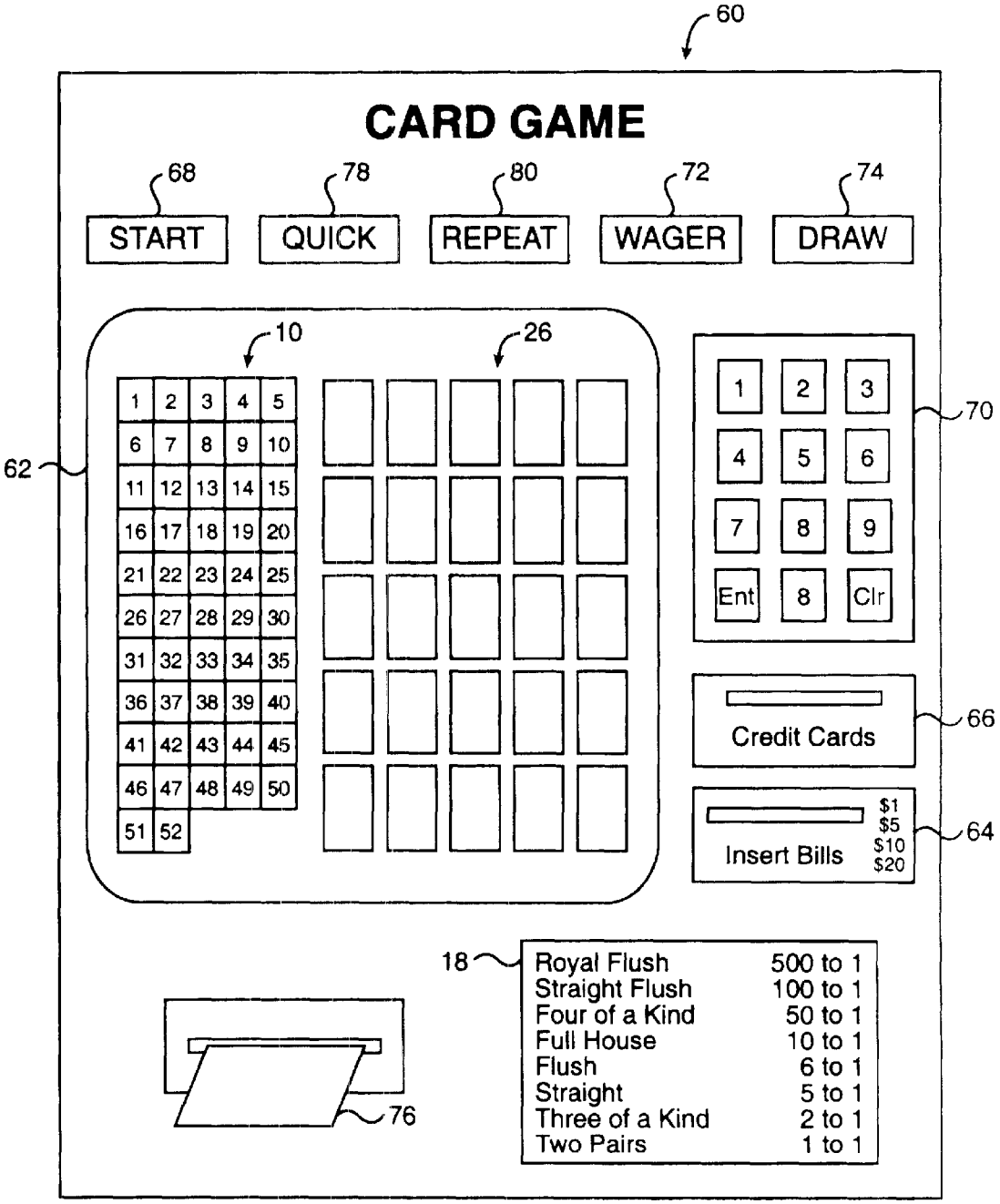
FIG. 14 is an example of a standalone machine embodying the display of FIG. 5.

With standalone machines, an example of which is shown in FIG. 14 implementing the display of FIG. 5, each player has her own terminal 60. An example is a video machine at a gaming establishment. The choosing grid 10 and playing grid 26 are displayed on the player's video screen 62. Prior to playing any game, the player inserts cash or tokens into a money reader 64 or swipes a credit or debit card in a card reader 66. The player begins a game by pressing the START button 68 and entering hey keypad 70 or the choosing grid 10. After the cards are chosen, the player presses the WAGER button 72 and indicates the amount to wager for the game. This can be done in any of several ways. One way is for the player to indicate the amount of wager on the keypad 70. Another way, and one that is unique to the present invention, is to input the amount of wager on the choosing grid 10 by pressing the card button corresponding to the amount of the wager, for example, card number 15 for a wager of $15. After the wager is made, the player presses the DRAW button 74 to complete the game. Winning amounts are credited to the player and may be printed on a voucher 76 for payment by a cashier or they may be paid in coins or other monetary tokens by the terminal itself. Optionally, the terminal 60 may include a QUICK button 78 to provide the player with a "quick pick" option, and/or a REPEAT button 80 so that the player may repeat the card choices from the previous game.

Alternatively, the standalone machine may be a personal computer on a network. Wagers can be made by debits to credit cards or debit cards or other cash equivalent, and payouts may be made by crediting credit or debit cards or other bank account.

The information transfer between the remote and central locations can occur on any communications system, including local-area and wide-area networks. In local-area networks, the remote locations and central location are in close proximity to each other, such as in a single building or building complex, and are typically wired directly together.

In wide-area networks, there is generally no limitation to how far the locations are from each other. Communication typically occurs over private leased telephone lines or public lines such as Internet connections. In some cases, the communication is wireless. In other cases, communication is over television cables.

Thus it has been shown and described a multiple round card game of chance which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A method of playing a card game with a set of cards, said method comprising the steps of:

(a) providing a payout schedule including a set of winning hands;

(b) allowing a player to place a wager on the outcome of said game based on said payout schedule;

(c) allowing said player only one opportunity to choose a predetermined number of said cards as chosen cards from a choosing grid having a location for each of said cards of said set of cards;

(d) randomly selecting a card value for at least each of said cards that become said chosen cards;

(e) revealing said card values for at least all of said chosen cards after said player chooses said chosen cards;

(f) forming a hand from said card values of said chosen cards; and (g) making appropriate payouts to said player after comparing said hand to a set of winning hands in said payout schedule.

2. The method of playing a card game of claim 1 wherein said method includes displaying said chosen cards on a playing grid separate from said choosing grid and revealing said card values on said playing grid.

3. The method of playing a card game of claim 1 wherein said method includes providing said player a means for playing said chosen cards from a previous game, said chosen cards from a previous game having new randomly-selected card values.

4. The method of playing a card game of claim 1 wherein said method includes providing said player with a means for randomly choosing said chosen cards.

5. The method of playing a card game of claim 1 wherein said method includes allowing said player to choose cards for more than one hand, said more than one hand being independent of each other.

6. The method of playing a card game of claim 5 wherein said method includes allowing said player to choose at least one combination of said chosen cards to form a secondary hand, where said secondary hand is compared to said winning hands in said payout schedule.

7. The method of playing a card game of claim 5 wherein said method includes randomly selecting a least one combination of said chosen cards to form a secondary hand, where said secondary hand is compared to said winning hands in said payout schedule.

8. A method of playing a stud poker type card game with a set of cards, said method comprising the steps of:

(a) providing a system having a central location and at least one remote terminal;

(b) providing a payout schedule including a set of poke-type winning hands;

(c) providing a player with a choosing grid having card locations, there being one of said card locations for each of said cards of said set of cards;

(d) allowing said player to choose a predetermined number of said cards as chosen cards on said choosing grid;

(e) receiving said chosen cards from said player at said terminal;

(f) receiving a wager from said player;

(g) providing said player with an acknowledgement of said chosen cards and said wager;

(h) randomly selecting a card value for at least each of said cards that become said chosen cards;

(i) revealing said card values for at least all of said chosen cards after said player receives said acknowledgement, (j) forming a hand from said card values of said chosen cards; and (k) making appropriate payouts to said player after comparing said hand to said set of winning hands in said payout schedule.

9. The method of playing a stud poker type card game of claim 8 wherein said choosing grid is printed on a slip of paper and said chosen cards are chosen by marking said paper slip in the appropriate card locations.

10. The method of playing a stud poker type card game of claim 8 wherein said choosing grid is displayed on a video touch screen and said chosen cards are chosen by touching said screen at the appropriate card locations.

11. The method of playing a stud poker type card game of claim 10 wherein said method includes providing said player with a means for playing said chosen cards from a previous game, said chosen cards from a previous game having new randomly-selected card values.

12. The method of playing a stud poker type card game of claim 8 wherein said acknowledgement is a paper receipt listing said chosen cards and said wager.

13. The method of playing a stud poker type card game of claim 8 wherein said card values are revealed on a public video screen.

* * * * *